United States Patent [19]

Germain

[11] 4,209,345

[45] Jun. 24, 1980

[54] MACHINE FOR TREATING METAL SHEETS

[75] Inventor: Alfred M. J. Germain, Grande Synthe, France

[73] Assignee: Union Siderurgique Dunord et de l'Est de la France (USINOR), Paris, France

[21] Appl. No.: 974,014

[22] Filed: Dec. 28, 1978

[30] Foreign Application Priority Data

Dec. 30, 1977 [FR] France ..... 77 39833

[51] Int. Cl.[2] ..... B08B 3/04; B05C 3/132

[52] U.S. Cl. ..... 134/122 R; 100/93 RP; 100/170; 266/111

[58] Field of Search ..... 134/64 R, 64 P, 122 R, 134/122 P; 100/93 RP, 170; 266/111-113

[56] References Cited

U.S. PATENT DOCUMENTS

| | | | |
|---|---|---|---|
| 2,896,646 | 7/1959 | Watson | 134/122 R |
| 2,900,951 | 8/1959 | Kabelitz | 100/170 X |
| 3,423,254 | 1/1969 | Safford et al. | 266/113 X |
| 3,885,581 | 5/1975 | Dahan et al. | 134/122 R |

*Primary Examiner*—Robert L. Bleutge

*Attorney, Agent, or Firm*—Cushman, Darby & Cushman

[57] ABSTRACT

The machine comprises a lower frame and an upper frame which define an enclosure in which the cooling fluid flows and carry sets of sheet guiding and driving rollers. Hydraulic jacks are provided for, on one hand, shifting the upper frame relative to the lower frame and, on the other hand, maintaining the upper frame in position in opposition to pressure forces in operation of the machine. Additional support means (41, 51) are provided on each of the frames and are associated with an adjusting mechanism (42,44) for determining with precision the position of the upper frame relative to the lower frame.

15 Claims, 4 Drawing Figures

MACHINE FOR TREATING METAL SHEETS

DESCRIPTION

The present invention relates to machines for treating metal sheets or like products and in particular to machines effecting an accelerated or hardening cooling. Such a machine is disclosed in particular in U.S. Pat. No. 3,885,581, and comprises an enclosure provided with a plurality of pairs of guiding and driving rollers and means for causing a stream of water to flow therein in a direction roughly parallel to the direction of the sheet to be cooled.

Such a machine must be capable of being adapted to sheets of different thicknesses. Consequently, the machine is constructed in the form of two units, namely a lower and an upper unit, the upper unit being movable relative to the lower unit and vertically adjustable. It is also essential to provide safety means operative in the course of operation of the machine as concerns the enormous pressure forces which are exerted on the moving unit. Thus, in operation, the force exerted by the liquid flowing between the sheet and the upper wall of the enclosure may exceed 150 metric tons for a weight of an upper unit of around 100 metric tons.

The object of the invention is to provide means for solving these two problems, namely: allowing a precise adaptation of the free height between the sets of rollers of the machine and providing a safety of operation which is as effective as possible.

According to the invention, there is provided a machine for treating, and in particular cooling, metal sheets or like products, comprising a lower frame and an upper frame, each frame carrying a set of rollers and defining a part of an enclosure in which a treating fluid flows, such as a cooling liquid, the upper frame being adapted to be vertically movable relative to the lower frame, wherein there are provided hydraulic jacks which permit, on one hand, in the known manner shifting the upper frame relative to the lower frame and, on the other hand, maintaining the upper frame in opposition to pressure forces in the course of operation of the machine, and, on each of the frames, additional support means associated with a regulating mechanism whereby it is possible to determine with precision the position of the upper frame relative to the lower frame.

According to other features of the invention:

the jacks comprise, in their hydraulic circuit, calibrated valves which are adapted to allow an escape of the hydraulic liquid when a predetermined force is exerted on the upper frame;

the additional support means comprise abutments carried by the upper frame and support means carried by the lower frame the position of which is determined by a common actuating mechanism;

the abutments carried by the upper frame comprise a packing block of adjustable thickness;

there are preferably provided pillars for guiding the upper frame with respect to the lower frame and means for blocking the upper frame with respect to the pillars;

a seal is provided between the lateral walls of the lower and upper frames by means of sealing elements which extend in a continuous manner throughout the length of the machine and are connected to a source of fluid under pressure.

This invention will now be described, in the application thereof to a machine for cooling metal sheets, with reference to the accompanying drawings which are given solely by way of example and in which.

Figure 1:
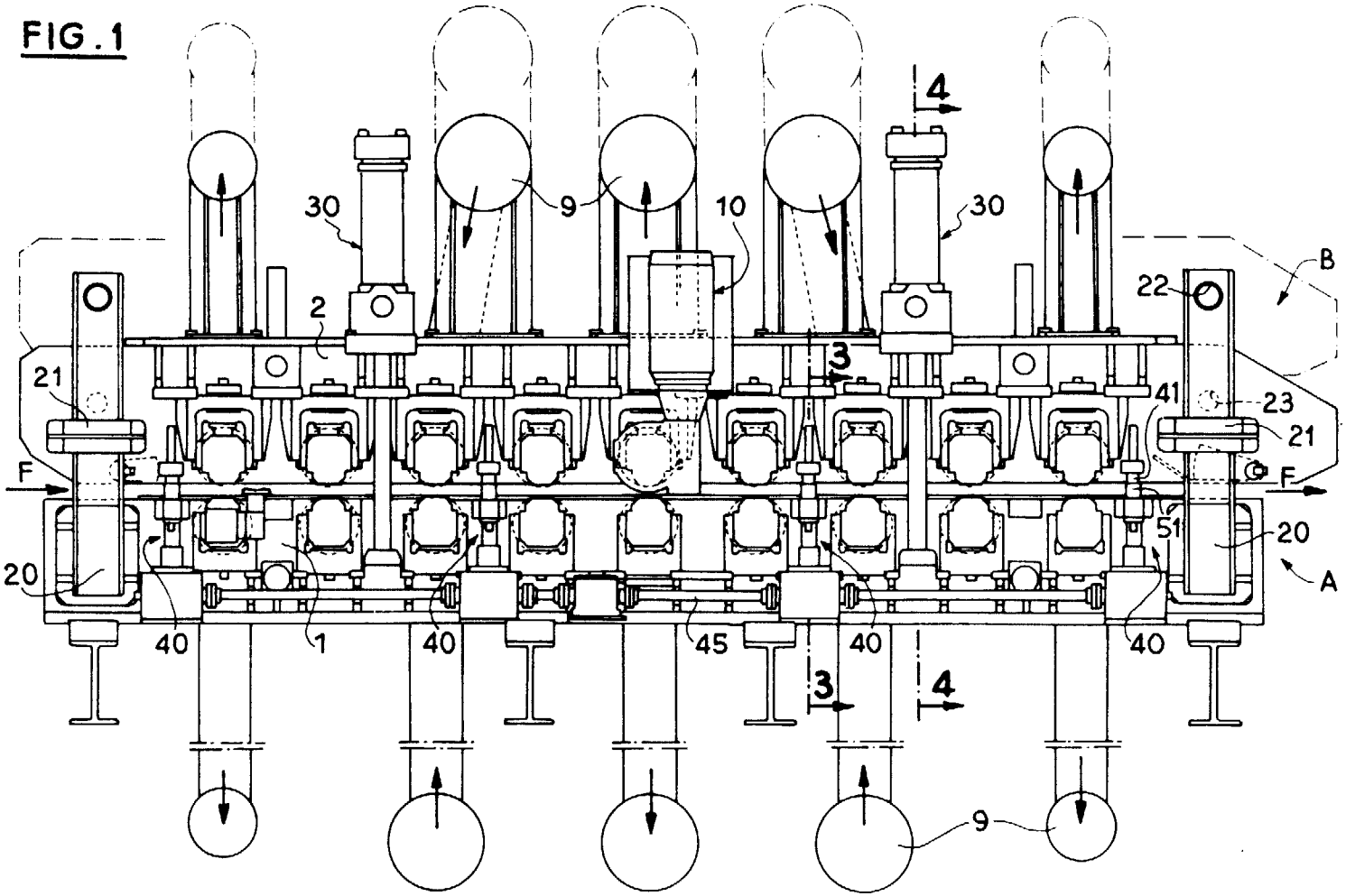
FIG. 1 is a somewhat diagrammatic side elevational view of such a machine, parts of which have been omitted for reasons of clarity.
Figure 2:
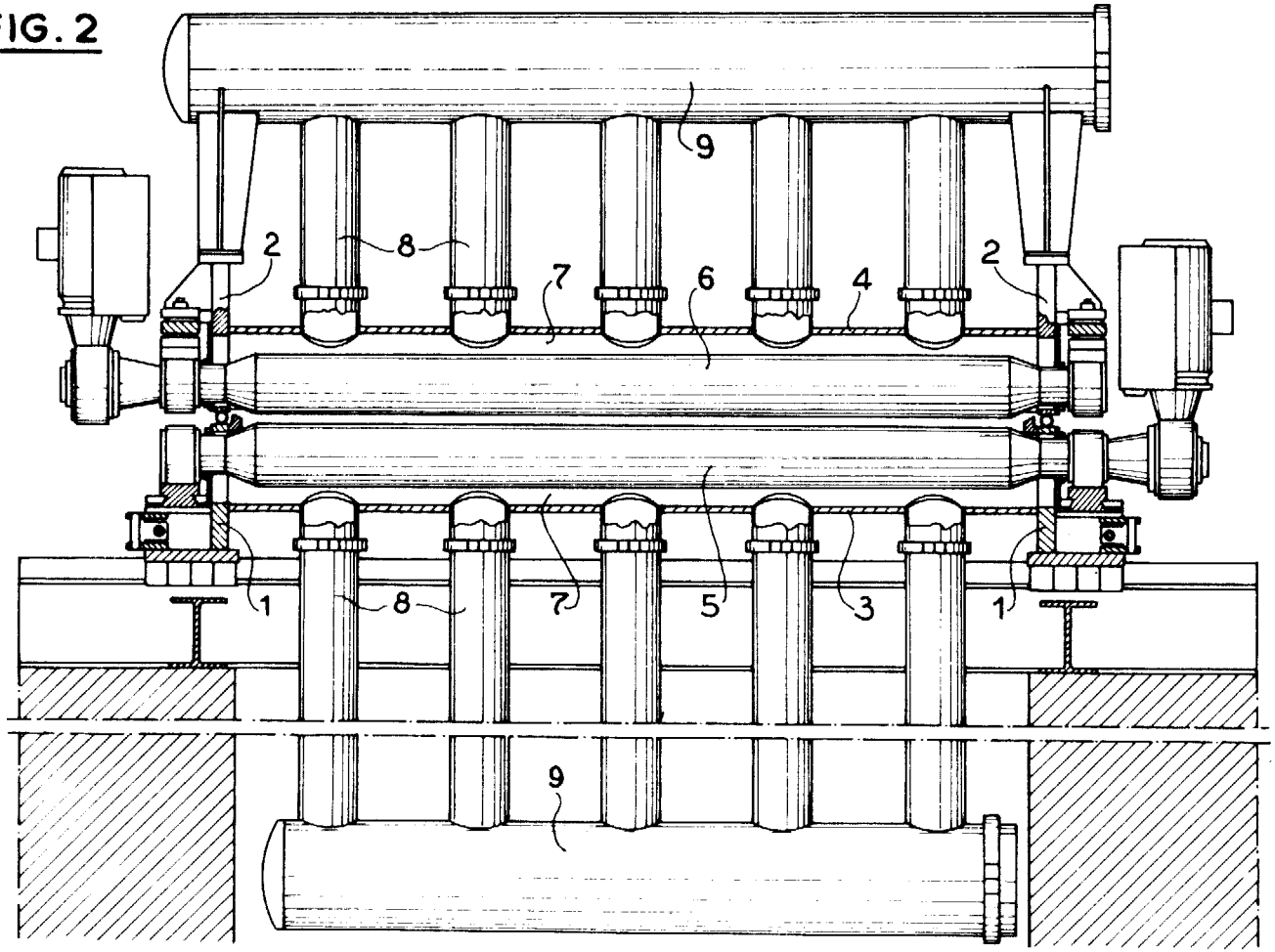
FIG. 2 is a transverse sectional view of the machine of FIG. 1.
Figure 4:
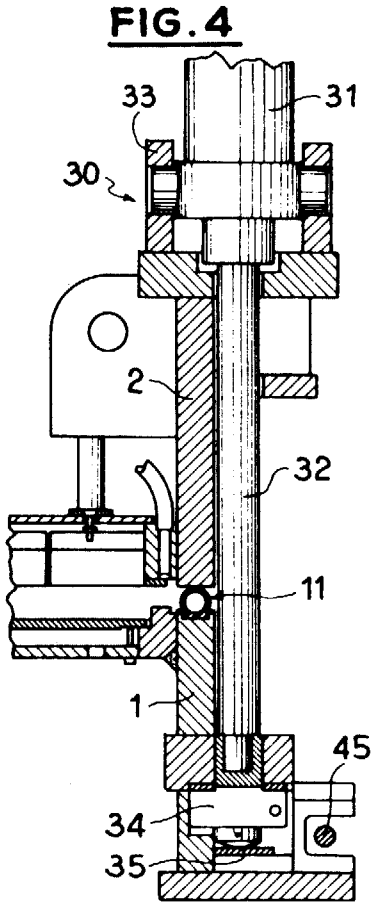
Figure 3:
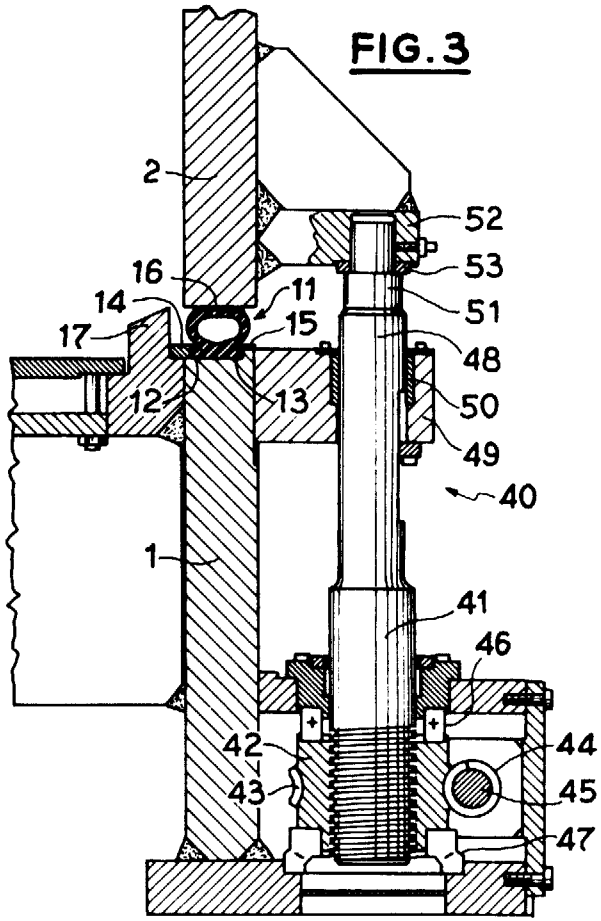

FIGS. 3 and 4 are two sectional detail views taken on lines 3—3 and 4—4 of FIG. 1, these views being however to different scales.

FIG. 1 shows a machine for effecting an accelerated cooling of metal sheets in which the sheets travel in the direction of arrows F. This machine comprises a fixed lower frame A and an upper frame B which is vertically movable. Each of these frames comprises two lateral walls 1, 2 formed by relatively thick plates, the two lateral plates of each frame being interconnected by cases 3, 4 which surround the sets of rollers 5, 6 and define an enclosure 7 for the cooling liquid. This enclosure is connected by pipes 8 to manifolds 9 which are connected, depending on the case, to sources of cooling liquid or to a device for drawing off this liquid (not shown). The directions of flow of the liquid are indicated by arrows in FIG. 1.

Each frame comprises a set of sheet guiding and driving rollers which are disposed in pairs and define therebetween gaps in which the sheet travels. In the illustrated embodiment, nine pairs of rollers are provided which are journalled in suitable supports and extend through the lateral walls of the machine with provision of a sealing element. These rollers are driven by motor-speed reducing units only one of which, 10, is shown in FIG. 1.

It is clear from FIG. 3 that the seal between the lateral walls 1, 2 of the two frames is achieved by means of sealing elements 11 of elastomer or other suitable material, which comprise a base 12 received in a recess 13 in the upper face of the lateral wall of the lower frame and maintained in this recess by side strips 14, 15. These sealing elements are hollow and may be connected to a source of fluid under pressure. Their wall 16, in contact with the adjacent face of the lateral wall of the upper frame, has ribs and grooves or any other like arrangement adapted to improve the adherence thereof to this adjacent face and to resist the pressures exerted by the cooling liquid. FIG. 3 also shows that a protective rib 17 extends alongside the inner face of the lateral wall of the lower frame in order to protect this sealing element from the high temperatures due to the closeness of the metal sheet travelling through the machine. This rib also acts as a guard for the widest sheets.

There will now be described the means for guiding and shifting the upper frame with respect to the lower frame. These means comprise firstly four pillars 20 which are rigid with the lower frame. Along two of these pillars the upper frame is guided by guide blocks 21 which will not be described in more detail. The other two pillars act as a support for the upper part in the upper position. Each pillar has in its upper part a recess 22 in front of which is capable of being placed a corresponding recess 23 formed in the lateral walls of the upper frame, the engagement of a pin in these two facing recesses enabling the upper frame to be maintained in its upper position.

The means for shifting the upper frame relative to the lower frame comprise four hydraulic jacks 30 which are positioned respectively at roughly one quarter and three quarters of the length of the machine. The jacks each comprise a cylinder or body 31 rigid with the upper frame and a piston rod 32 connected at its lower end to the lower frame. This is shown more clearly in FIG. 4 where it can be seen that the jack body is mounted on the upper frame to be pivotable about a horizontal axis since it is journalled in a fork 33. At its lower end, the piston rod is secured to the lower frame by a key 34 and the end of this piston rod bears against the lower frame by a part-spherical bearing surface 35. The jack piston rods are subjected to compressive stresses when the jacks are in use for raising the upper frame, but they are subjected to tensile stresses when the machine is operating and the jacks ensure that the upper frame is maintained in position relative to the lower frame. The fluid supply circuit for these jacks comprises safety valves (not shown) which are so calibrated as to allow the escape of the hydraulic fluid when the vertical force exerted on the upper frame exceeds a given value.

The means provided for ensuring the precise positioning of the upper frame relative to the lower frame comprise eight mechanical units, namely four units on each side of the machine. One of these units is shown in more detail in FIG. 3. Each of these units comprises a screw jack 40 carried by the lower frame and comprising in the presently-described embodiment a vertical rod 41 which is screwthreaded in its lower part and cooperates with a nut 42 which is provided with teeth 43 which are engaged by a worm 44 carried by a longitudinally extending shaft 45. The nut 42 is disposed between a thrust ball bearing 46 having a single effect and a self-aligning thrust roller bearing 47. In its upper part 48, the rod 41 is guided by a bracket 49 provided with a suitable lining 50 and rigid with the lateral plate 1 of the frame and it defines at its upper end a bearing surface for an abutment member 51 carried by a bracket 52 rigid with the upper frame. This abutment member is positioned in height by means of a spacer block 53. This block is on principle placed in position once and for all when assembling the machine and enables the eight support means 51 to be placed at the same level. The eight screw jacks which position the upper frame are actuated simultaneously by transmission shafts 45 which extend from one side of the machine to the other, means being furthermore provided for driving these shafts in synchronism.

The operation of the assembly just described has not been explained in full detail. It will merely be mentioned that, upon assembly, the abutment members 51 of the upper frame are positioned in a precise manner so as to thereafter permit a simultaneous and precise adjustment of the position of the upper frame relative to the lower frame by means of the eight screw jacks 40 which are actuated and shifted simultaneously. This adjustment of the position of the screws is carried out while the hydraulic jacks are supplied with hydraulic fluid so as to place the upper frame in a relatively high position and in any case at a height exceeding the height at which they must be in operation. In the case of repairs requiring the upper frame to be maintained in an upper position for a long period of time, this upper frame is brought to the extreme position, shown in dot-dash lines in FIG. 1, and it is blocked in this position relative to the vertical pillars by pins placed in the orifices 22 and 23.

In operation, the upper frame bears on the eight support means and the hydraulic jacks then have for function to maintain this upper frame in position in opposition to the forces that are exerted thereon in the vertically upward direction by the pressure of the cooling liquid flowing inside the enclosure. The valves provided in the fluid supply circuit for these jacks provide safety in the event of a large overpressure and then allow a displacement of the whole of the upper frame in the upward direction.

Having now described my invention what I claim as new and desire to secure by Letters Patent is:

1. A machine for cooling metal sheets or like products, comprising:

a lower frame and an upper frame, each frame carrying a set of rollers and including means defining at least part of an enclosure in which enclosure a cooling liquid is to flow for cooling the metal sheets;

the upper frame being mounted to be vertically movable relative to the lower frame;

a plurality of hydraulic jacks connected to the upper frame for shifting the upper frame relative to the lower frame and for maintaining the upper frame in position at a selected height, in opposition to pressure forces tending to move the upper frame upwards during operation of the machine, and additional support means combined with an adjusting mechanism for precisely setting independently of said hydraulic jacks the position of the upper frame relative to the lower frame.

2. A machine as claimed in claim 1, wherein the jacks have bodies which are carried by the upper frame and rods which are connected to the lower frame at ends of the rods.

3. A machine as claimed in claim 1, comprising a hydraulic circuit connected to the jacks to actuate the jacks and calibrated valves in said circuit and operative to allow an escape of the hydraulic liquid when a predetermined force is exerted on the upper frame.

4. A machine as claimed in claim 1, wherein the additional support means comprise abutments carried by the upper frame and support members carried by the lower frame, and a common shifting mechanism is associated with the support members to set the position of the support members.

5. A machine as claimed in claim 4, wherein the abutments carried by the upper frame comprise a spacer block of adjustable thickness.

6. A machine as claimed in any one of the claims 1 to 5, comprising pillars for guiding the upper frame relative to the lower frame and means for blocking the upper frame relative to the pillars.

7. A machine as claimed in any one of the claims 1 to 5, wherein the frames each have two lateral walls and a seal is provided between each corresponding two lateral walls of the two frames by means of a hollow sealing element which extends continuously throughout the length of the machine, a source of fluid under pressure being connected to the hollow sealing elements.

8. A machine as claimed in claim 7, wherein the lateral walls of the upper frame and lower frame comprise continuous facing edges between which edges the sealing elements are disposed.

9. A machine as claimed in claim 7, wherein each sealing element comprises a base fixed in a recess in one of the lateral walls and a portion in contact with the other lateral wall, which portion has elongate projections for improving the adherence of the sealing element to said other lateral wall.

10. A machine as claimed in claim 7, comprising a protective rib carried by one of said frames in the vicinity of an edge of each sealing element which faces inwardly of the machine.

11. A machine for treating a sheet of metal, comprising:

a lower frame having two laterally opposite sides and two longitudinally opposite ends, a lower frame and an upper frame vertically juxtaposed with said lower frame;

each frame carrying a set of rollers, arranged so that the two sets of rollers may rollingly confront opposite faces of the sheet that is to be treated;

an enclosure for treating fluid having one part thereof secured to the lower frame to remain therewith and another part thereof secured to the upper frame to move vertically therewith, and means forming respective seals between said two parts at respective sides of said lower frame;

said enclosure being open at two opposite ends for permitting feeding of the sheet that is to be treated between the two sets of rolls;

conduit means communicating with the enclosure for pressurized feeding of treating fluid thereto and for draining treating fluid therefrom;

a plurality of vertically-oriented supports distributed about said juxtaposed frames;

each said support having a bearing means fixed with respect to said lower frame, and a precisely raisable/lowerable abutment member supported thereon and having a shoulder means supporting the upper frame against downward movement with regard to an adjustable-height datum provided by said shoulder means on said abutment member, but permitting movement of said upper frame above said datum;

means for raising and lowering all of said abutment member in unison in order to raise and lower said datum;

a plurality of vertically-oriented jacks distributed about said juxtaposed frames;

each jack comprising a double-acting fluid pressure-operated piston/cylinder arrangement having one end fixed with respect to the lower frame and another end secured to the upper frame, and means for supplying pressurized fluid to all said piston/-cylinder arrangements to selectively extend and retract all the respective pistons thereof both to raise the upper frame to and even above the datum being provided by said shoulder means, and to forcibly hold said upper frame down to said datum during sheet treatment.

12. A machine as claimed in claim 11, wherein:

each said support is constituted by a screw jack having a lower part secured to the lower frame and containing said bearing means thereof and a nut journalled on said bearing means, and a vertical rod screw-threaded into the nut, said vertical rod constituting said abutment member and having said shoulder means formed thereon; and the means for raising and lowering the abutment members is constituted by means for simultaneously rotating all of said nuts by the same amount.

13. A machine as claimed in claim 12, wherein:

each nut is provided with a set of gear teeth extending thereabout and the means for simultaneously rotating the nuts comprises a plurality of shafts assembled in a gear train including a plurality of gears each in driving relation with the said set of gear teeth on at least two said nuts.

14. A machine as claimed in claim 12, wherein:

each vertical rod has an upper end, below which the respective said shoulder is formed as an upwardly facing annular shoulder, the rod above said shoulder being of reduced diameter to provide an upwardly-projecting pin;

bracket means on said upper frame having means defining a plurality of downwardly opening sockets therein;

each upwardly projecting pin being received in a corresponding said socket from below, and each said shoulder supportingly engaging said bracket means about each said socket.

15. A machine as claimed in claim 14, wherein:

each said seal means between said upper and lower frame is provided with seal inflating means for helping to maintain sealing between said upper and lower frames for a range of upper frame heights even though said datum may be raised and lowered.

* * * * *